United States Patent [19]

Pauliukonis

[11] Patent Number: 4,824,081

[45] Date of Patent: Apr. 25, 1989

[54] PISTONLESS-PLUNGER POSITIONER WITH INTERNAL CYLINDER AND ANNULAR FLUID SPACE

[75] Inventor: Richard S. Pauliukonis, Cleveland, Ohio

[73] Assignee: Grazina J. Pauliukonis, Cleveland, Ohio

[21] Appl. No.: 37,778

[22] Filed: Apr. 13, 1987

Related U.S. Application Data

[63] Continuation-in-part of Ser. No. 714,967, Mar. 22, 1985, Pat. No. 4,667,780.

[51] Int. Cl.[4] ..... F16F 9/32

[52] U.S. Cl. ..... 267/64.12; 188/300

[58] Field of Search ..... 92/170; 188/300, 317, 188/319, 322.21, 299, 312, 313, 316; 267/64.12

[56] References Cited

U.S. PATENT DOCUMENTS

| | | | |
|---|---|---|---|
| 1,294,014 | 2/1919 | Worster | 137/533 |
| 2,912,002 | 11/1959 | Miller | 137/541 |
| 3,177,980 | 4/1965 | Porter | 188/319 |
| 3,343,833 | 9/1967 | Fader | 188/313 |
| 3,359,802 | 12/1967 | Sollenberger | 188/313 |
| 3,420,341 | 1/1969 | Keehn, II | 188/319 |
| 3,656,593 | 4/1972 | Bauer | 188/300 |
| 3,762,514 | 10/1973 | Freitag | 188/300 |
| 3,920,253 | 11/1975 | Bauer | 188/313 |
| 4,036,335 | 7/1977 | Thompson | 188/319 |
| 4,113,220 | 9/1978 | Godwin | 188/300 |
| 4,257,582 | 3/1981 | Wirges | 188/300 |
| 4,526,088 | 7/1985 | Reuschenbach | 188/317 |
| 4,570,669 | 2/1986 | Pauliukonis | 137/528 |
| 4,667,780 | 5/1987 | Pauliukonis | 188/300 |

FOREIGN PATENT DOCUMENTS

| | | | |
|---|---|---|---|
| 118138 | 4/1900 | Fed. Rep. of Germany | 137/528 |

*Primary Examiner*—Robert E. Garrett
*Assistant Examiner*—George Kapsalas
*Attorney, Agent, or Firm*—Marius J. Jason

[57] ABSTRACT

A gas cylinder for applications requiring height adjustments such as found in chairs, stools, or like structures supported by columns. The cylinder has an elongated rechargeable unit of double-wall construction provided with a springless check valve inside a fluid port thereof preferably all of molded plastic. A single-piece sealed plunger assembly includes a single actuating rod with velocity controls incorporated therein which permit vertical extension from collapsed to fully-extended positions. Depression of the actuating rod allows circulation of the pressurized fluid between the chambers, with pressure force acting to extend the plunger when the unit is unloaded. When the unit is loaded, the plunger can be retracted.

10 Claims, 1 Drawing Sheet

PISTONLESS-PLUNGER POSITIONER WITH INTERNAL CYLINDER AND ANNULAR FLUID SPACE

This is a continuation-in-part of my earlier application Ser. No. 714,967, filed Mar. 22, 1985, now U.S. Pat. No. 4,667,780 issued May 26, 1987.

BACKGROUND OF THE INVENTION

This invention relates to servo cylinders generally and to self-contained servo gas cylinders pre-charged with compressed working fluid for operation without external power specifically.

In the parent application it has been demonstrated vividly that the use of linear actuators energized by a working fluid under pressure in a self-contained rechargeable system that employs tubular housing as a fluid reservoir comprising of two fluid chambers separated by a piston to maintain fluid pressure therein so as to either lock piston and rod assembly in a selected axially variable position or to allow axial motion within stroke limitations permitted in order to find its own position consistent with a closed-loop servo system operation requires utilization of simple directional check valve in the cylinder charging end including metering valve means for speed control incorporated into a actuating rod means of the unit be it metal or plastic or a combination thereof. However, many applications require cost reduction beyond that identified in the construction cited even when the unit is injection molded from plastics. Further, safety consideration necessitated design modification in the original unit operating with simplified O-ring mounting without increase of production cost. Finally, broadening the application commanded other changes.

SUMMARY OF THE INVENTION

The object of the present invention is therefore to provide design improvements for simplified construction of the servo gas cylinder produced most economically. More specifically, the object of the present invention is to replace conventional large diameter piston normally attached to a substantially smaller diameter piston rod at a considerable cost by a novel plunger,a head of which of substantially the same diameter as that of the plunger body replaces the piston in one application while in another application the plunger has neither head nor piston attached thereto but a seal inside a peripheral groove at a first end of an elongated plunger body of one and the same diameter, opposite to a second end thereof.

Further object of the present invention is to provide plastic servo gas cylinder with novel operational controls.

Additional object of the present invention is to provide servo gas cylinders which require fewer components, are light and corrosion resistant.

Servo gas cylinders of this general type are obviously desirable because they provide a simple, inexpensive and reliable means for serving many applications beyond those common to the prior art.

Specifically, airline, automotive and bike industries, among many others wherein reduction of weight is at premium would benefit from this novel development considerably.

Plastic servo gas cylinder of the present invention designed to employ a plunger instead of the conventional piston and rod assembly are not only lighter than metal counterparts of prior art but they can provide superior service with extreme reliability at less cost initially and in service.

These and other objects and advantages of the invention will become more fully apparent from the description of the embodiment of the invention, taken together with the accompanying drawing:

DETAILED DESCRIPTION OF THE PREFERRED EMBODIMENTS

Figure 1:
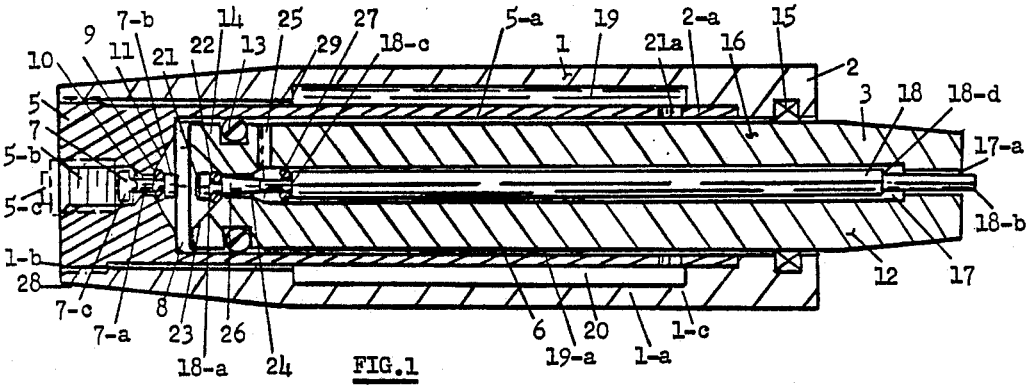
FIG.1 is a cross-section of a plunger type servo gas cylinder in a first plunger retracted position wherein a seal inside a peripheral groove serves as a head instead of piston including a dual cylinder housing of the present invention.

FIG. 1 servo gas cylinder represents an all plastic simplified unit construction with pistonless plunger 16 inside a dual cylinder housing 1 with an annulus 19 therebetween. In FIG. 1, an elongated tubular housing 1-*a* may be injection molded with an integral end wall 2 at the protruding plunger end 3 and an opposite end wall 5 with an integral elongated internal cylinder 5-*a* adaptable of being inserted into a housing bore 20 against a counterbore 2-*a* bottom to form the annulus 19 after a plunger assembly 12 is sealably spaced inside cylinder bore 6. End wall 5 may be secured inside housing first open end 1-*b* by threads or otherwise fixed by ultrasonic welding or equally strong spinning techniques considered standards in plastics industry. The same pertains to the end wall 2 inside second opposite end 1-*c* of the housing 1-*a* if desired but if ultrasonic welding is chosen for attaching the end wall 2 to the end 1-*c* of housing 1-*a* ,no parting lines between the parts assembled will be visible, as can be seen in FIG. 1 by reference to the end wall 2. A fluid port 5-*b* central to the end wall 5 is provided for supply of the working fluid under pressure,be it compressed air, nitrogen or carbon dioxide gas alone or mixed with lubricants or hydraulic oils delivered into the cylinder inside 8 via a floating check valve 7 incorporated therein. The check valve 7 consists of a tee-shaped floating pin 7-*a* having a round head 7-*b* at the first pin end protrude into the cylinder inside 8 via an orifice 10 of port 5-*b* for securing therein by a seal 9 inside a peripheral groove adjacent a seat 11,while the opposite larger size second pin end 7-*c* may be flat of tee-configuration shown or it may be winged to provide a stop for axial pin motion inside port 5-*b* while permitting unobstructed fluid flow into the cylinder during the cylinder charging.

Note that during cylinder charging, the fluid pressure forces the pin 7-*a* along with seal 9 floatingly away from seat 11 to permit fluid supply into the cylinder inside 8. However, when the supply of the working fluid from outside is disconnected, the position of the pin 7-*a* reverses automatically due to internal fluid force action over pin head 7-*b* so as to force seal 9 tight against seat 11 rendering check valve bubble-tight shut. An end plug 5-*c* inside port 5-*b* must be used to secure the unit free of tampering and operational during an extended service life, unless a need arises to recharge the unit via port 5-*b* again for either augmentation or lowering of internal force including maintenance of the unit requiring cylinder depressurization which is done by removing plug 5-*c* and applying an external force against the tee 7-*c* of pin 7-*a* to unseat the seal 9 from the seat 11 rendering check valve 7 open to exhaust. The captured working fluid under pressure inside cylinder proper exerts a pressure force over plunger assembly 12 equivalent to plunger area defined by the diameter of a plunger seal 13 spaced peripherally inside a groove thereof times the pressure urging a position change of the plunger assembly 12 from that shown in FIG.1 to another (not shown) with plunger assembly 12 extended beyond the end wall 2 as far as the plunger stroke permits. The stroke is measured by the distance traveled by the seal 13 of a first plunger end 14 inside the cylinder bore 6 normally provided with appropriate abutments. Theoretically,the plunger assembly 12 of FIG.1 has unlimited stroke,since the seal 13 can travel from the position shown passed a stationary housing seal 15 inside appropriate groove of end wall 2 when subjected to an end pressusure at cylinder inside 8 forcing the cylinder assembly 12 to disengage from cylinder bore 6 unless restricted externally within stroke selected between that shown in FIG.1 with plunger retracted to another(-not shown) with plunger extended but not more than up to the counterbore 2-*a* shown. In practice, therefore, the stroke of gas cylinder of FIG.1 is controlled by the application wherein external means to restrict plunger travel are present, unless plunger is provided with a head at the end 14 to act as a stop defining the stroke inside the gas cylinder boundaries instead,as per plunger modifications shown in FIG.2.

Plunger assembly 12 of FIG. 1 consists of an elongated hollow plunger 16 provided with a central passage 17 between the plunger ends adaptable of receiving an elongated actuating rod 18 spaced inside thereof so as to terminate with a metering valve 18-*a* in the end 14 for regulation of fluid flow between fluid chambers at each side of the the seal 13 formed inside cylinder proper when plunger assembly is urged to move axially therein.

Assuming that the internal stroke of FIG.1 gas cylinder is restricted by external abutment means defining stroke limitations without plunger disengagement from bore 6 of a first internal cylinder 5-*a* of the dual cylinder housing 1 in service, the unit operation can be defined as follows.

When the actuating rod 18 becomes moved from the position of FIG.1 externally by pressing physically over a protruding first rod end 18-b, an opposite second end 21 thereof inside plunger end 14 unseats a seal 22 of metering valve 18-*a* from a face 23 covering an orifice 24 for fluid communication between fluid chambers at each seal 13 side formed inside cylinder proper urging plunger position change from that of FIG.1 with plunger retracted to a second plunger extended position (not shown). FIG.1 identifies a first fluid chamber formed at cylinder inside 8 facing both the check valve 7 and the plunger face 23 however limited in size due to adjacent location of seal 13 which separates it from a second fluid chamber on the right thereof. the second chamber of FIG.1 is formed by the annulus 19 jointly with a small annular space 19-*a* between the outside diameter of plunger 16 and the inner diameter of bore 6 interconnected by a radial hole 21-*a* at the end of cylinder 5-*a* adjacent counterbore 2-*a*. Conversally, no motion of plunger assembly 12 will materialize until flow between chambers is established to proceed from a first fluid chamber via orifice 24 passed a metering taper 26 of the second rod end 21 into the passage 17 protected by a seal 27 so as to direct the flow via radial hole 25 into the second fluid chamber or vice-versa,depending on the position plunger assembly 12 has assumed inside bore 6.

In turn, an infinite number of positions is selectable within a given stroke at speeds controllable by metering valve 18-*a* inside orifice 24. Depressing end 18-*b* of actuating rod 18 more increases the speed of plunger motion due to increased orifice flow taper 26 permits between chambers. Releasing rod end 18-*b* automatically stops the motion, rendering plunger fixed at any position selected due to the fluids trapped in each respective chamber and protected by seals 22 and 27 respectively. Seal 27 at a shoulder 18-*c* of actuating rod 18 is always slightly larger than the seal 22 resulting in a larger pressure end force over seal 27 so that the whole actuating rod 18 automatically returns to a first rod seal 22 bubbletight shut position with rod end 18-*b* protruding plunger end 3 for actuation externally. Also is to note the fact that the rod end 18-*b* entering a reduced diameter oppening 17-*a* of passage 17 is smaller than the diameter of the actuating rod 18 forming a shoulder 18-d therebetween to eliminate a potential rod discharge via oppening 17-*a* into the outside like a missile in case of O-ring 22 failure in the opposite second rod end 21 at the plunger face 23, providing extra safety features to the present servo gas cylinder.

Tapers shown on the housing end by 28 as well as on plunger end 3 of FIG.1 identify most simple accepted means for unit attachement to a structure such as a chair allowing taper 28 enter a mating receiver bore of a base(not shown) while the tapered plunger end 3 may be received by a tapered receiver under the seat thereof, but they do not represent the limits. Other means of unit attachment to a structure such as a chair, stool ,table or the like may be selected from threaded to shouldered end configurations without departing from the scope and spirit of the invention with equal success. Conversaly, the cylinder mounting along with attaching the plunger end into a structure in the field is selectrable from tapers of FIG.1 shown alone or in combination with many other options. In some applications it may be preferable to use a servo gas cylinder with housing end tapered while the plunger end is hexagonal, or even square, while in other applications the cylinder end may be flush and provided with a threaded boss even when plunger end is tapered. Conversally, the unit of FIG.1 does not have to be made from plastics.

However, when produced from plastics, this design is much superior to conventional piston and rod assembly originally considered as well as used in prior art designs. This is so because of manufacturing costs which can be reduced drastically when injection molding a plunger of uniform size in lieu of conventional designs even when plunger is provided with a small head as that shown in FIG.2 instead of a larger diameter piston that must be connected securely to a rather sharply reduced diameter of piston rod.

Further, the use of a plunger as defined in the present specification versus a piston and rod assembly of prior art is beneficial in many other ways. Specifically, reduced plunger diameter with or without a head greatly improves cylinder space utilization factor in that it allows to increase plunger stroke without increasing overall length of the housing. This can be seen even from FIG.1 wherein the first plunger end 14 is spaced substantially midway of taper 28 of the housing end rather than at the internal shoulder 29 thereof as would be the case if piston were used instead.

Finally, the use of plunger instead of piston inside cylinder as described and used in the parent application contributes to safety in a certain specific way in that the use of double wall housing structure provides departamentation of sorts in case of cylinder failure in service with plunger fully extended to the stroke limitation and chamber 19 becomes damaged relieving pressure therefrom while the first chamber at cylinder inside 8 is in tact thereby minimizing the effect of such failure.

The design of FIG.1 therefore provides novel means for producing economical gas servo cylinders which can be made from plastics at reduced cost and operated with capabilities no prior art devices of this general type entail, including means for speed control and unit discharge and re-charge means for varying forces in the field, and for field maintenance.

Figure 2:
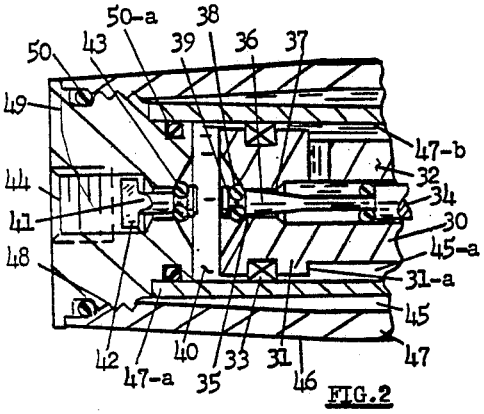
FIG.2 is an end section of FIG.1 showing cylinder and plunger details and includes modified plunger end provided with a small head of a diameter which includes a shoulder to serve as plunger stop during plunger position change.

FIG.2 shows an end section of FIG.1 modified structurally in small detail since operationally the gas cylinder of FIG.2 performs exactly the same function as that of FIG.1. Specifically, FIG.2 gas cylinder is aimed to serve applications that require internal restrictions with appropriate abutments for plunger stroke limitations. Ergo, FIG.2 plunger assembly 32 will incorporate a plunger 30 that includes a plunger head 31 with a shoulder **31-*a* serving as a stop and a seal 33 otherwise totally identical to the plunger assembly 12 of FIG.1 in all detail. For example,the actuating rod 34 of FIG.2 is the same as the actuating rod 18 of FIG.1. And so is the metering valve 35 with a tapered section 36 inside orifice 37 closed by a seal 38 adjacent second rod end 39 protruding into a first fluid chamber 40 across a check valve 41 with a springless floating stem 42 provided with a seal 43 inside a groove thereof so as to render valve bubble-tight shut automatically by internal pressure of working fluid housed therein after charging the cylinder via port 44 of FIG.2,functionally identical to that of FIG.1 already described in detail. The only difference,therefore,is in details which outside of plunger 30 with head 31 include modifications such as an increased length of annulus 45 by elimination of taper shoulder 29 of FIG.1 so that FIG.2 annulus 45 can be increased to the maximum by extending tapered wall 46 of external housing tube 47 up to the threads 48 of an end wall 49 provided with an end seal 50 including a peripheral seal 50-*a* at the end of internal cylinder 47-*a* which in FIG.2 is not an integral part of the end wall 5 of FIG.1. This is so for a specific purpose namely to accomodate higher pressures and closer bore tolerances, let alone economics in case of difficulty to produce molded cylinders without draft in bore 47-*b* of internal cylinder 47-*a* serving longer strokes. Finally, the use of plunger with head 31 providing shoulder 31-*a* to limit stroke against an appropriate abutment inside opposite housing end(not shown in FIG.2 but in FIG.3) when plunger 30 is fully extended increases also the volume of a second chamber formed by annulus 45 jointly with annular space 45-*a* formed by shoulder 31-*a*. In turn,this compensates for difference in volumes of the opposing chambers and improves unit operation in that pressures on both sides of plunger head become equallized. For example, assuming the plunger head is $1\frac{1}{8}''$diameter having 0.994 inch$^2$ surface would create a volume in a first chamber with stroke 5" long,$V_1=5\times0.994=4.97$ cu in. Assuming plunger is only 1" dia with 0.785 in$^2$ surface by 5" long, the annular volume thereof will be $(0.994\ \text{in}^2-0.785\ \text{in}^2)\times5''=1.04$ cu in. Adding volume of annulus 45** to the above,using the same assumption that 5" is the lenght thereof but the inner diameter of the external tubular housing is say $1\frac{1}{2}''$ while to outer diameter of the inner cylinder is say $1\frac{1}{4}''$ both being very realistic will provide a volume in a second chamber as follows:

$$1.04\ \text{cu in}+(1.76\ \text{in}^2-1.23\ \text{in}^2)\times5''=1.04+2.65=3.69\ \text{cu in}=V_2$$

Comparing volumes, we see that $V_1=4.97$ cu in is larger than $V_2=3.69$ cu in and the ratio of volumes $V_1/V_2=4.97/3.69=1.35$ is considered good in practical terms. Obviously, increasing length of annulus 45 to enter housing taper 46 described before is beneficial in ratio improvement so that when plunger 30 is fully retracted the pressure in chamber two does not increase above safe limits but is close to that of chamber one satisfying the objectives of this invention. It is important to note here that such beneficial volume ratio would be impossible to obtain using conventional piston and rod assembly unless charging pressure is increased by an order of magnitude resulting in rather small piston rod capable of exerting large end force, contrary to the present design principle using plastics and low operating pressures acting over large diameter rods or plungers for equivalent end forces. In turn, the present invention is related to low pressure unit operation rather than the high pressure units of the prior art. Ergo, any structural relationship of the present invention to that of the prior art is purely coincidental because of cited differences in not only design but in the operational principles as well.

Figure 3:
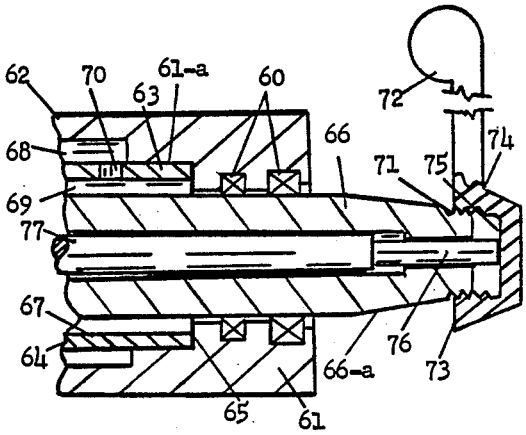
FIG.3 is another opposite end section of FIG.1 showing details of both the cylinder and the plunger end including external actuating means for operational control.

FIG.3 shows an end section of an opposite end of FIG.1 modified to include dual plunger seals 60 one of which may be a rod wiper spaced inside an integral end wall 61 of a housing 62, identical to that of FIG.1, plus a counterbore **61-*a* with an end 63 of an internal cylinder 64 abutting a shoulder 65 thereof with ample radial shoulder space to accomodate the head of the piston with shoulder 31-*a* of FIG.2 therein as a stop,limiting the stroke of a hollow plunger 66 inside cylinder bore 67 of FIG.3. Like in FIG.2, FIG.3 shows an annulus 68 of external housing 62 in communication with an internal annual space 69 via a radial hole 70. Unlike in FIG.1, plunger 66 of FIG.3 terminating with a tapered plunger end 66-*a* incorporates threads 71 adaptable of receiving external controls 74 with mating threads inside a cap 73 provided with a flat bottom 75 which is in contact with an end 76 of an actuating rod 77 to permit gradual depression of the actuating rod downwards when external controls 74 are turned sideways by protruding handle 72** facilitating novel means of unit operation with resultant plunger position change already described.

Figure 4:
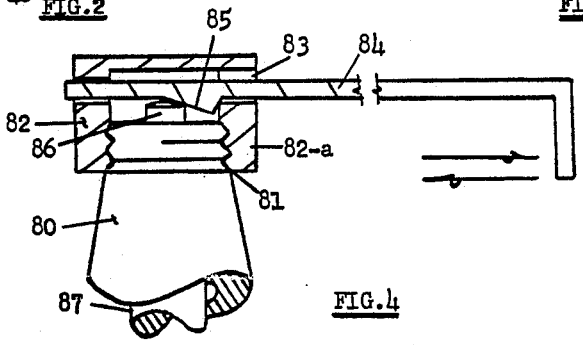
FIG.4 is a section of plunger end with alternate operational control means.

FIG.4 identifies another version of external controls at the end of a tapered plunger 80 protruded with threads 81 to receive a mating cap assembly 82 which includes a cap **82-*a* with appropriate elangated slot 83 passing therethrough said adaptable of receiving therein a substantially flat actuating handle 84 in final assembly. Handle 84 is provided with a cam like surface 85 adjacent a protruding end 86 of an actuating rod 87 so as to gradually depress end 86 when handle 84 is pushed to the left forcing cam surface 85 over actuating rod end 86 externally thereby opening internal fluid passages for fluid communication between respective fluid chambers to result in plunger travel for position change in accordance with the preceding description. Pulling handle 84 to the right perm rod return to the original normally extended position rendering metering valve of FIG.1 or FIG.2** bubble-tight closed, and vice-versa.

In operation, upon a slight depression of actuating rod or either FIG.1, FIG.2 or FIG.3 the plunger can be set into motion. Depressing the actuating rod of servo cylinder of the present invention more increases the speed of such motion due to increased orifice flow between fluid chambers tapered rod portion of the metering valve permits. Releasing the actuating rod automatically stops the motion rendering plunger fixed in a position desired within stroke limitation incorporated therein due to the fluids trapped in each respective fluid chamber. The design of servo gas cylinder in accordance with FIG.1 and FIG.2 with external controls of FIG.3 and FIG.4 therefore provides novel means of producing economical lifting devices of this specific type which when made from plastics are less costly to purchase and more safe to operate within standard precautions in great many applications such as bicycle seats, boating seats, airline stools including executive chairs and specialty equipment among many others requiring light weight and corrosion resistant characteristics no prior art devices entail.

The designs above identifying a preferred embodiment are not limited to unit construction from plastics in case of uncovery of other novel materials and/or manufacturing techniques adaptable to servo gas cylinders, including metal.

It will be obvious to those skilled in the art that various changes may be made in the above designs without departing from the scope of the invention, and the invention is not to be considered limited to what is shown in the drawings and described in the specification.

What is claimed is:

1. A servo gas cylinder comprising:

a pressurized tubular column including a first internal cylinder spaced therein with a first end open and adapted to receive a hollow pistonless plunger with a head seal slidably movable therein forming fluid chambers at both head sides including fluid communication passage means therebetween interconnected with external control means with fine adjustment means incorporated therein to facilitate plunger position change from a first retracted to a second extended positions including means for locking the plunger therein, while an internal cylinder second end is closed and provided with cylinder charging and discharging means with pressurized working fluid via a floating check valve means inside a fluid supply port means incorporated therein, a first fluid chamber in said internal cylinder second end, a coaxial externally spaced second cylinder interconnected with said first internally spaced cylinder so as to form an annulus therebetween along the length thereof to serve as a second fluid chamber jointly with an annular space formed by said plunger inside said first internal cylinder including a radial hole means for fluid communication therebetween adjacent said open end thereof,said first internal cylinder abutting a counterbore shoulder of an end wall of both cylinders, a metering valve means inside said hollow plunger incorporated therein so as to allow metered fluid flow between said fluid chambers facilitating plunger position change at controlled speed, an actuating rod means inside said hollow plunger interconnected with said metering valve means and adaptable of external actuation thereof for flow initiation between said fluid chambers, means for attaching said tubular column by the ends thereof to a structure means subject to height adjustment, and when said actuating rod means becomes pushed down against a biasing force of the working fluid housed therein the flow between fluid chambers initiates facilitating motion of said plunger until said actuating rod means is released at a position selected defining height desired for an automatic plunger locking and vice versa, within stroke limitations provided therein.

2. A device as in claim 1 wherein said actuating rod means are secured to a threaded first plunger end protruding a first end of said tubular column, opposite to said second closed end of said first internal cylinder,so as to gradually move a protruding end of said actuating rod downward for flow initiation, said external controls including a threaded cap provided with an elongated handle positioned therein normal to the cap axis and adaptable to side motion resulting from said external actuation of said actuating rod means.

3. A servo gas cylinder comprising:

an all plastic one-piece tubular housing one end of which is open and adapted to receive an elongated internal cylinder with a bore passing therethrough between the ends thereof, a first end of the internal cylinder being adapted to receive an all plastic substantially pistonless elongated plunger assembly which sealably protrudes said open end of said housing, a second end of said internal cylinder being closed and provided with a fluid port for cylinder charging and discharging by way of a check valve incorporated therein, means for securing said internal cylinder inside said tubular housing by way of attaching said second end of said internal cylinder to another open end of said tubular housing permanently, while said first end of said cylinder abuts a counterbore of said housing,said plunger assembly being slidable inside said cylinder bore between a first plunger retracted and a second plunger extended positions forming fluid chambers at each side of a plunger head with a seal incorporated therein, a central opening along the entire plunger assembly length adapted to receive an actuating rod therein having a first small diameter rod end with a peripheral seal groove enter and protrude an orifice at the end of said center opening to be secured by a first small seal while a second actuating rod end protrudes a second plunger end which extends from the open housing end, a second larger diameter seal on said actuating rod spaced against a shoulder thereof is mounted therein sealably inside said central opening to automatically close said orifice due to a pressure force larger than that exerted over said first seal on a side opposite the orifice side, a fluid communication means between said chambers controlled by said actuating rod, and when said actuating rod is depressed by pushing externally on said second protruding rod end against the internal biasing pressure force acting on said second seal, said orifice becomes open for fluid communication between said fluid chambers facilitating plunger motion with position change for a desired height, and when said actuating rod is released,the height selected becomes fixed by the opposing forces of fluid pressure exerted on said plunger from both directions.

4. A servo gas cylinder comprising:

A rechargeable pressurized tubular column with dual cylinders of which a first external cylinder represents a housing thereof while a second internal cylinder of slightly shorter length performs a pressure lifting function by a pistonless hollow slidable plunger assembly adaptable of being mounted therein to serve in equipment means, said first cylinder including a bore passing therethrough between the open ends thereof of which a first end is provided with an end wall having a central plunger opening of a size smaller than the bore size including peripheral grooves for seals and a short counterbore spaced inside thereof for accomodating a first fully open end of said second internal cylinder against a shoulder provided therein that also serves as a stop for a head of said plunger during plunger position change in service,- while a second open end of said first cylinder is adapted to be closed by a blind end of said second internal cylinder initiating a blind bore passing therethrough to exit said first fully open end of the second cylinder mounted against said shoulder of said counterbore adapted to receive said plunger assembly with a head seal slidably movable therein between a first plunger head retracted position adjacent said blind end thereof and a second plunger rod extended position limited by said head at said counterbore shoulder, the head seal forming fluid chambers at both head sides, a first annulus formed between first external and second internal cylinders and a second annulus formed between an external surface on the plunger assembly and an internal surface on said blind bore, the first and second annuli being interconnected by a radial hole in a wall of said second cylinder adjacent the open end for defining a first fluid chamber, a fluid port in said blind end of said second internal cylinder provided with a springless check valve for charging and discharging fluid under pressure to and from the second cylinder, the fluid port being in communication with a second fluid chamber totally separated from said first fluid chamber by a metering valve incorporated into a face of said plunger subject to external control, an actuating rod means inside said hollow plunger interconnected with said metering valve for control of metered flow between said fluid chambers facilitating plunger position change at variable speeds depending on the amount an actuating rod externally protruding plunger end becomes depressed, means for mounting said tubular column by the ends thereof into said equipment means, and means for operating said tubular column by external control means, and when said actuating rod become depressed, flow between said fluid chambers permits plunger assembly position change until said actuating rod becomes released at a desired position at which time the plunger assembly will be locked by internal pressure forces automatically closing said metering valve.

5. A device as in claim 4 wherein said tubular column with dual cylinders including said pistonless plunger assembly and said actuating rod means are produced by injection molding from plastics, along with a check valve stem, and said external cylinder with said first end wall comprises a one piece construction while said second cylinder with said blind end wall is also one piece construction produced by injection molding from plastics, including said plunger assembly with an integral head incorporated therein by molding from plastics in one piece along with one piece construction of said actuating rod assembled with said plunger (in) assembly in the final steps of cylinder assembly.

6. A device as in claim 4 wherein said first external cylinder with said first end wall is injection molded in one piece, including said second end wall thereof integral thereto produced from plastics, while said second internal cylinder is from metal to result in a double walled tubular column requiring long stroke thereby facilitating mixed unit fabrication by combining plastic with metal components assembled sealably together.

7. A device as in claim 4 wherein said external control means include a cap secured to external threads on the protruding plunger end, said cap provided with a lever for fine adjustment of said actuating rod end when said lever is moved horizontally back and forth so as to facilitate cam action provided therein capable of gradual depression of said actuating rod end when the horizontal direction is changed, moving said lever to the opposite direction unloads said actuating rod automatically when said cam surface disengages said rod end.

8. A device as in claim 4 wherein said second end wall of said second cylinder is detacheable while said first end wall of said first cylinder is integrally molded into said cylinder housing.

9. A device as in claim 4 wherein said cylinder operation includes an inner pressure force acting upward equivalent to a plunger rod area times the pressure while the force acting downward is an outside weight exerting a larger force than said inner pressure induced end force facilitating said plunger assembly position change when said actuating rod is depressed.

10. A device as in claim 4 wherein said plunger assembly is metal while all other parts are plastic.

* * * * *

UNITED STATES PATENT AND TRADEMARK OFFICE

CERTIFICATE OF CORRECTION

PATENT NO. : 4,824,081

DATED : April 25, 1989

INVENTOR(S) : Richard S. Pauliukonis

It is certified that error appears in the above-identified patent and that said Letters Patent is hereby corrected as shown below:

Column 6, line 68, "said" should read -- and --.

Column 7, line 10, "perm" should read -- permits an automatic --.

Column 10, line 26, delete "(in)".

Signed and Sealed this

Twenty-first Day of November, 1989

*Attest:*

JEFFREY M. SAMUELS

*Attesting Officer* *Acting Commissioner of Patents and Trademarks*